US010850361B1

(12) United States Patent
Dovel

(10) Patent No.: US 10,850,361 B1
(45) Date of Patent: Dec. 1, 2020

(54) POWERED SHARPENER WITH MANUAL HONE STAGE

(71) Applicant: Darex, LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 0 days.

(21) Appl. No.: 16/887,913

(22) Filed: May 29, 2020

Related U.S. Application Data

(60) Provisional application No. 62/854,077, filed on May 29, 2019.

(51) Int. Cl.
*B24B 3/54* (2006.01)

(52) U.S. Cl.
CPC ..... *B24B 3/546* (2013.01)

(58) Field of Classification Search
CPC ..... B24B 3/546; B24B 3/00; B24D 15/06; B24D 15/068; B26D 7/12; B23D 73/00
USPC ..... 451/45, 70
See application file for complete search history.

(56) References Cited

U.S. PATENT DOCUMENTS 4,716,689 A 1/1988 Friel
4,807,399 A * 2/1989 Friel ..... B24B 3/54 451/267
5,906,534 A 5/1999 Folkman et al.
6,012,971 A 1/2000 Friel, Sr. et al.
6,071,181 A 6/2000 Wightman et al.
6,113,476 A 9/2000 Friel, Sr. et al.
6,261,161 B1 * 7/2001 Yan ..... B24B 3/463 451/192
6,267,652 B1 7/2001 Friel, Sr. et al.
6,726,551 B2 4/2004 Friel, Sr.
6,752,702 B1 6/2004 Thompson et al.
6,863,600 B2 3/2005 Friel, Sr.
7,517,275 B2 4/2009 Friel, Sr. et al.
8,043,143 B2 10/2011 Elek et al.
8,267,750 B2 9/2012 Friel, Sr. et al.
8,585,462 B2 11/2013 Jensen et al.
8,678,882 B1 3/2014 Huber et al.
9,168,627 B2 10/2015 Elek et al.
9,242,331 B2 1/2016 Elek et al.
9,649,749 B2 5/2017 Weiner et al.
9,656,372 B2 5/2017 Weiner et al.
2008/0261494 A1 10/2008 Friel et al.
(Continued)

*Primary Examiner* — George B Nguyen
(74) *Attorney, Agent, or Firm* — Hall Estill Attorneys at Law

(57) ABSTRACT

Apparatus and method for sharpening a cutting tool, such as a kitchen knife. A sharpener has a base unit and one or manual sharpening modules. The base unit has a housing which encloses at least one flexible abrasive disc rotated by an electric motor. Each flexible abrasive disc is adjacent a powered sharpening stage to perform a primary sharpening operation upon the tool. Each manual sharpening module may be removably attachable to the base unit and has a manual sharpening stage that incorporates at least one sharpening element to perform a secondary sharpening operation upon the tool. Each manual sharpening module further has a powered stage guide surface to form a portion of a corresponding powered sharpening stage. When two powered sharpening stages are used, the manual sharpening module(s) can be individually placed between the powered sharpening stages to provide opposing powered stage guide surfaces for each.

24 Claims, 6 Drawing Sheets

(56) References Cited

U.S. PATENT DOCUMENTS

| | | | | |
|---|---|---|---|---|
| 2011/0034111 | A1 | 2/2011 | Elek et al. | |
| 2011/0201257 | A1* | 8/2011 | Walker | B24B 3/54 451/45 |
| 2012/0015590 | A1 | 1/2012 | Li | |
| 2013/0165021 | A1* | 6/2013 | Jensen | B24D 15/06 451/41 |
| 2013/0324014 | A1* | 12/2013 | Dovel | B24B 3/36 451/45 |
| 2015/0258651 | A1* | 9/2015 | Elek | B24B 9/065 451/45 |
| 2017/0232568 | A1 | 8/2017 | Dovel | |
| 2018/0104796 | A1 | 4/2018 | Wu | |

* cited by examiner

POWERED SHARPENER WITH MANUAL HONE STAGE

RELATED APPLICATIONS

The present application makes a claim of domestic priority to U.S. Provisional Patent Application No. 62/854,077 filed May 29, 2019, the contents of which are hereby incorporated by reference.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors and chisels, have a first opposing surface that extends in a substantially normal direction, and a second opposing surface that is skewed with respect to the first surface.

Complex blade geometries can be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, abrasive belts, etc.

SUMMARY

Various embodiments of the present disclosure are generally directed to an apparatus and method for sharpening a cutting tool, such as but not limited to a kitchen knife.

In some embodiments, a sharpener is provided for sharpening a cutting tool having a cutting edge. The sharpener has a housing, a flexible abrasive disc mounted to a central shaft within the housing to provide a powered sharpening stage, an electric motor disposed within the housing and configured to rotate the flexible abrasive disc in a selected rotational direction, and a manual sharpening module removably attachable to the housing at a location adjacent the powered sharpening stage. The manual sharpening module has a powered stage guide surface configured to support a first side of the cutting tool during presentation of an opposing second side of the cutting tool against the flexible abrasive disc to effect a primary sharpening operation upon the cutting edge. The manual sharpening module further has an elongated access slot to facilitate movement of the cutting tool against a manual sharpening element along a cutting tool drawing axis to effect a secondary sharpening operation upon the cutting edge.

In related embodiments, a sharpener is provided for sharpening a cutting tool having a blade with opposing first and second sides that converge to an intervening cutting edge. The sharpener includes a housing, first and second flexible abrasive discs mounted to a central shaft in a spaced apart relation within the housing to provide opposing first and second powered sharpening stages, an electric motor disposed within the housing and configured to rotate the first and second flexible abrasive discs in a selected rotational direction, and a manual sharpening module affixed to the housing between the first and second powered sharpening stages. The manual sharpening module has opposing first and second guide surfaces configured to respectively support the opposing first and second sides of the blade during presentation of the corresponding second and first sides of the blade against the respective first and second flexible abrasive discs. The manual sharpening module further has a honing stage having an elongated access slot to facilitate presentation of the cutting edge against a manual honing element disposed within the access slot.

In further related embodiments, a method is provided for sharpening a cutting tool having opposing first and second sides that converge to an intervening cutting edge. The method includes inserting the cutting tool into a first powered sharpening stage of a powered sharpener to perform a primary sharpening operation upon the cutting edge, the powered sharpener having a housing which encloses an electric motor configured to rotate a first flexible abrasive disc in a selected rotational direction, and a removably attachable manual sharpening module having a main body with a powered stage guide surface and an interior manual sharpening element, the powered stage guide surface supporting the second side of the cutting tool during contacting engagement of the first side of the cutting tool against the first flexible abrasive disc; and drawing the cutting tool through an elongated slot of the manual sharpening module to draw the cutting tool against the manual sharpening element to perform a secondary sharpening operation upon the cutting edge.

These and other features and advantages of various embodiments can be understood from a review of the following detailed description in conjunction with the accompanying drawings.

DETAILED DESCRIPTION

Figure 1:
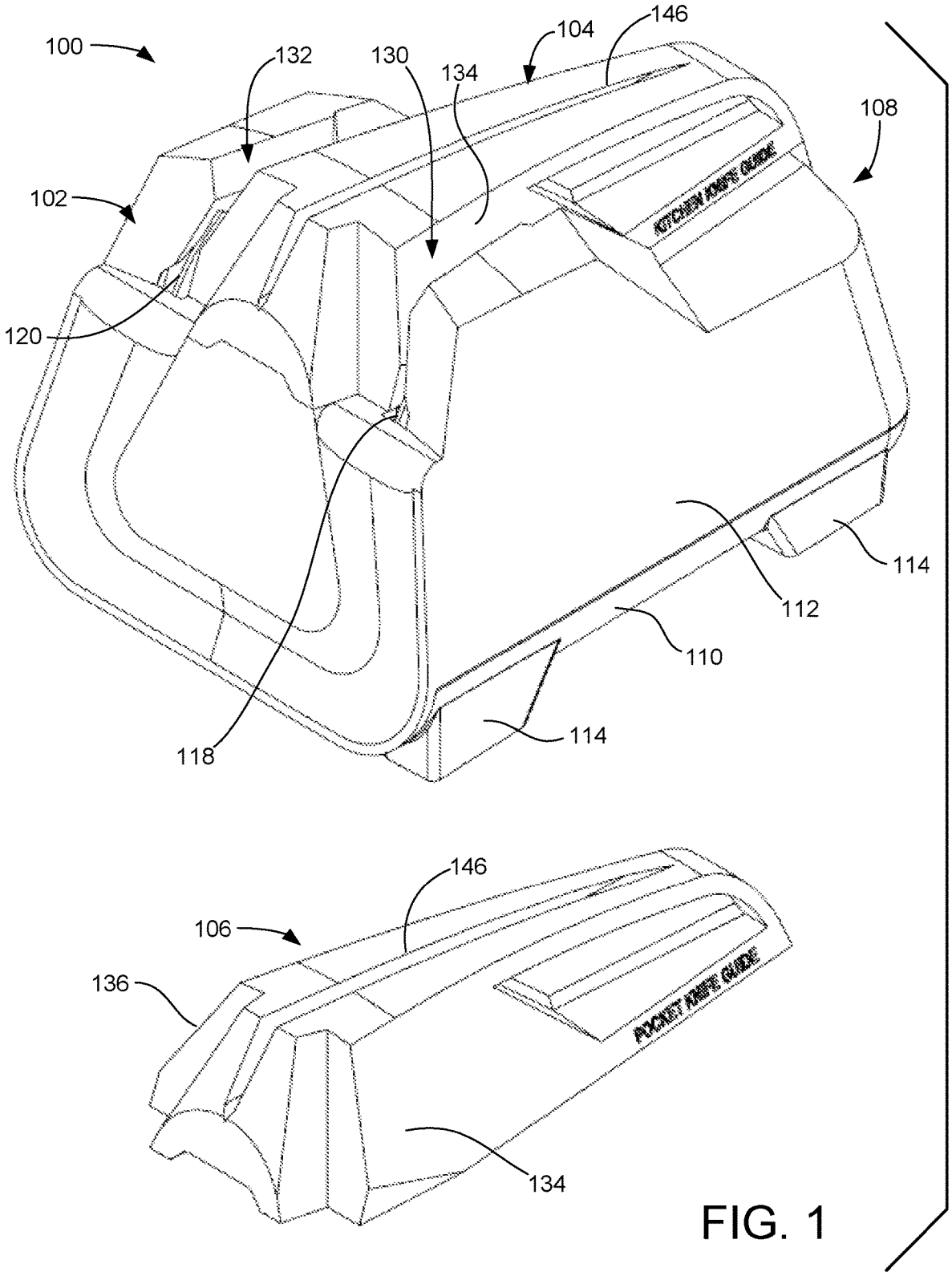
FIG. 1 provides an isometric representation of a powered tool sharpener constructed and operated in accordance with various embodiments of the present disclosure.

Various embodiments of the present disclosure are generally directed to a powered knife and tool sharpener, and to a method for using the same. As explained below, the sharpener includes a base unit with powered abrasive media and one or more manual sharpening modules with manually activated abrasive media. Within the base unit, an interior motor drives a central transverse shaft to which one or more flexible rotatable abrasive discs are mounted. It is contemplated that two discs will be used, one on each side of the shaft, but this is not necessarily required. The motor shaft is parallel to the disc shaft and power transfer takes place using a power transfer mechanism such as a belt and pulley system.

Stationary sharpening guides are provided to enable the user to repetitively present opposing sides of a knife or other cutting tool against the interior facing rotating surfaces of the abrasive disc(s). The flexible discs may incorporate sandpaper or similar media of a flexible nature adapted to provide an abrasive surface that removes material from the presented cutting tool to conform an outer shape of the cutting tool to a desired cutting geometry.

In at least some embodiments, the discs can be rotated at two different speeds, a slower "sharp" setting and a faster "shape" setting. Each of these can be activated by pressing respective buttons located near the rear of the sharpener housing, which in turn causes the motor to operate at different settings to effect the desired sharpening operation.

A manual sharpening module is removably attached to a central top portion of the base unit. When two discs are used, the manual sharpening module may be positioned between the opposing rotatable abrasive discs. The manual sharpening module has a central slot through which the user can insert the blade after the powered sharpening operations using the abrasive discs. The manual sharpening module can be used while the module is affixed to the base unit, or can be used in a hand-held fashion as the user holds the module in the user's hand or places the module on a suitable support surface such as a counter-top. The purpose of the manual sharpening module is to apply a fine (hone) sharpening operation upon the cutting edge of the tool after the tool has been sharpened using the powered abrasive.

The module incorporates a manual sharpening element, which may take the form of a double canted sharpening wheel with two frusto-conical surfaces in facing relation to one another. The wheel may be formed of a single piece of ceramic, and is canted at an acute angle with respect to the central slot. Advancement and retraction of the blade provides a honing action upon the blade as the blade is concurrently acted upon by both of the frusto-conical discs. The honing action can operate to remove burrs and provide refined shaping of the cutting edge. Other arrangements for the manual sharpening element can be used, including but not limited to a pair of intersecting sharpening elements such as abrasive wheels, rods, plates, blocks, etc.

In further embodiments, two different manual sharpening modules are provided for use with the base unit of the sharpener. One manual sharpening module is configured for use with knives having relatively thin blades, such as kitchen knives, and the other sharpening module is configured for use with knives having relatively thick blades, such as pocket knives. The different manual sharpening modules may be adapted to provide different sharpening geometries, such as different shapes or angles, to the cutting tool. As noted above, the modules can be used either while attached to the housing, while holding the module in the user's hand, or by placing the modules on a flat base surface.

Outside surfaces of each module provide angled support (guide) surfaces for use during the sharpening against the abrasive discs in the base unit. The different manual sharpening modules can provide different presentation angles of the respective blades against the rotating media. In some embodiments, the pocket knife module has a larger sharpening angle (e.g., about 25 degrees) as compared to the kitchen knife module (e.g., about 20 degrees). In this way, a selected sharpening module can not only provide the desired coarse ground sharpening angle as the tool is subjected to the powered coarse sharpening operation, but can also provide a suitable corresponding fine honing operation to provide a desired fine ground sharpening angle as the tool is subsequently honed.

Both modules may be removed and attached to the housing by sliding the associated module forward, and engaging a rigid hook that locks the associated module into place. Removal of the module allows a top cover of the base unit to be raised using a set of hinges, providing easy access to the abrasive discs and other interior aspects of the sharpener. Contrawise, installment of the module onto the rigid hook locks the top cover in place. In some cases, a stationary scissors support is formed in the top surface of the base unit to allow a user to sharpen a pair of scissors against a selected one of the abrasive discs when the module is removed from the base unit.

The abrasive disc(s) may be mounted to the central shaft using annular disc retainers. The disc retainers cover a substantial portion of the backing layer of each abrasive disc, such as by having a radius that is nominally about 50% of the radius of the associated abrasive disc. This places an edge of the disc retainer at a location below a contact area on the opposing side of the associated disc to provide a biasing force to increase the surface pressure and material take off (MTO) rate during the sharpening operation. In some cases, the retainer operates to provide higher surface pressure for thicker blades and reduced surface pressure for thinner blades.

The powered flexible abrasive discs can take a variety of constructions. In some embodiments, the discs are formed of double sided sandpaper so as to have opposing outer abrasive surfaces on a medial backing layer. Other constructions can be used, such as a flexible abrasive disc with a foam intermediate layer that compresses to allow conformal shaping during the sharpening operation.

These and other features and advantages of various embodiments can be understood beginning with a review of FIG. 1 which shows a powered tool sharpener 100. The powered tool sharpener 100 includes a base unit 102 and a pair of removably engageable manual sharpening modules 104, 106. The module 104 is shown connected to the base unit 102 and the module 106 is shown to be separated from the base unit. Either module can be installed onto the base unit as required. In some cases, the base unit is also referred to herein as the main unit or the powered unit.

As explained in greater detail below, the module 104 is generally configured for relatively thinner blades (e.g., the "kitchen knife module") and the module 106 is generally configured for relatively thicker blades (e.g., the "pocket knife module"). It will be appreciated that the provision of two (or more) modules is merely exemplary and is not necessarily required. Moreover, the removable nature of the modules is not necessarily required in at least some embodiments.

Figure 2A:
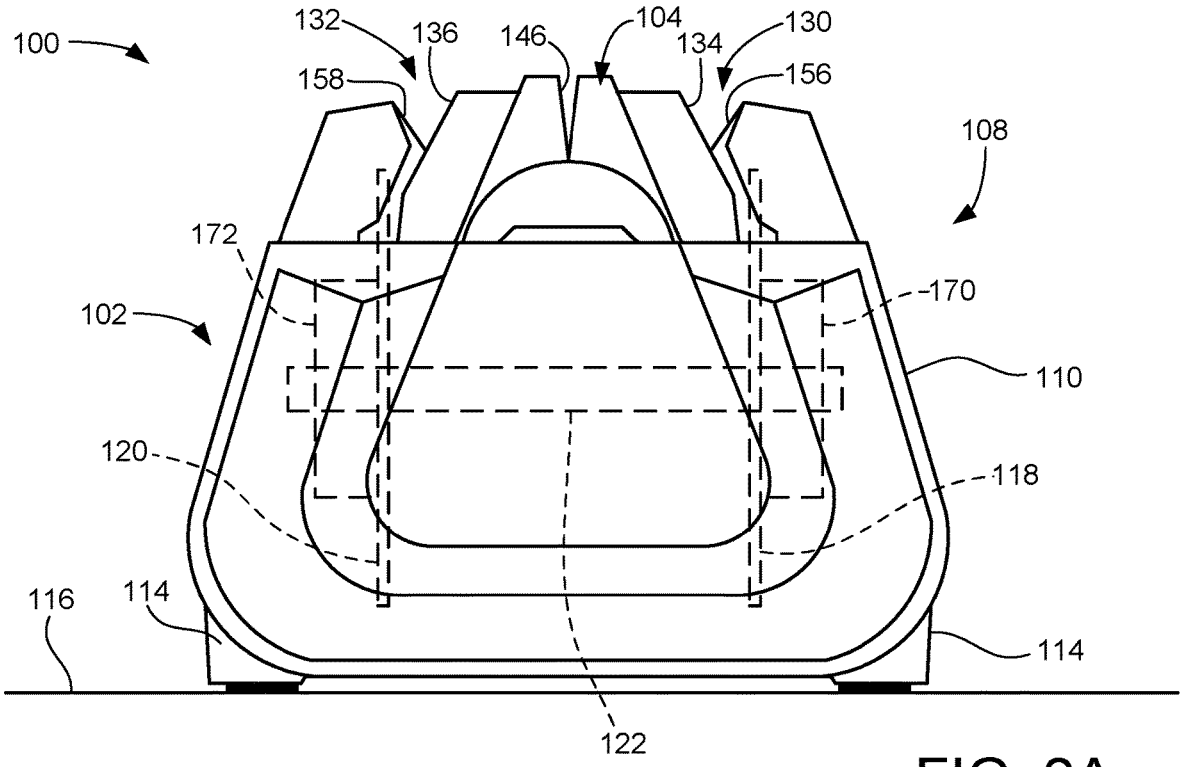
FIGS. 2A and 2B provide respective front and side views of the sharpener of FIG. 1.
Figure 2B:
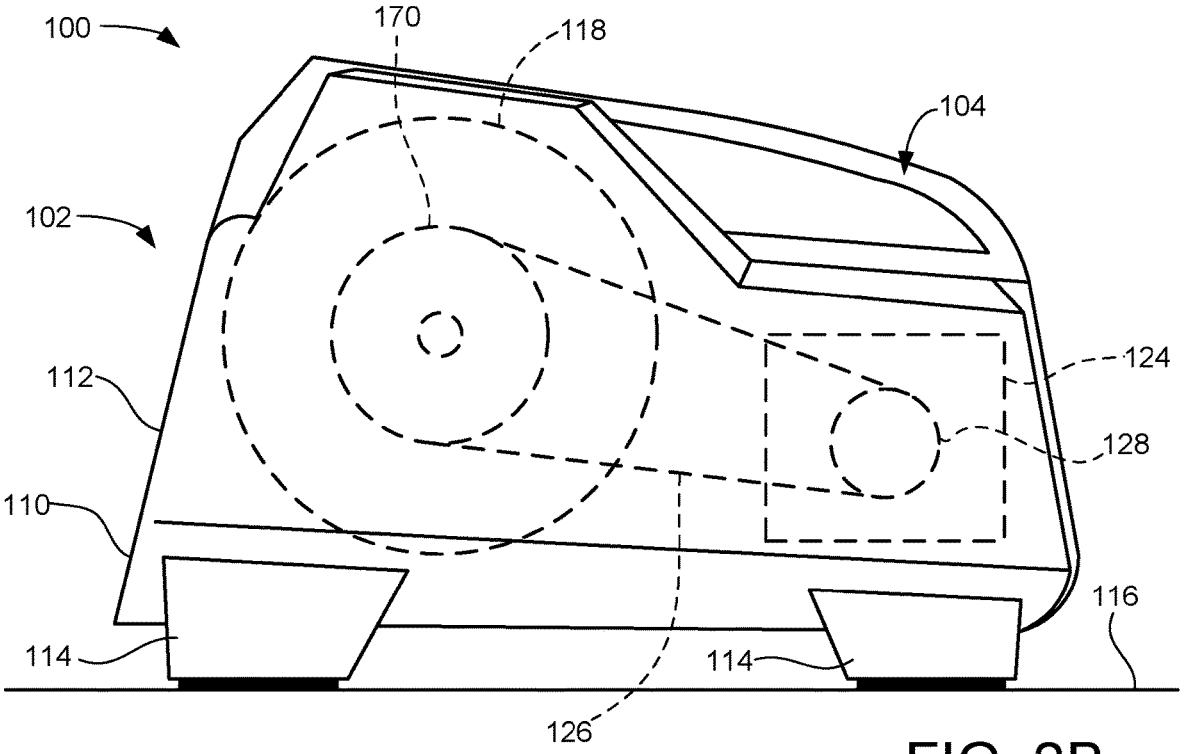

As further depicted in FIGS. 2A and 2B, the base unit 102 has a housing 108 formed of a base member 110 and a top cover 112. The base member 110 includes a set of support members (feet) 114 with non-skid features adapted to support the sharpener 100 on an underlying base surface 116. While not separately shown, the respective manual sharpening modules 104, 106 can be provided with similar non-skid features for separate support and use on the base surface.

Enclosed within the housing 108 are a pair of rotatable flexible abrasive discs 118, 120. The discs 118, 120, also sometimes referred to as the first and second discs, are arranged for rotation about a central shaft 122 which is rotated using a drive system having an electric motor 124, a belt 126 and pulley 128, as generally depicted in FIG. 2B. Further details regarding the drive system are provided below.

A pair of sharpening ports 130, 132 (also sometimes referred to as powered sharpening stages) are provided in the top cover 112 to provide access to the interior surfaces of the abrasive discs 118, 120. Opposing guide surfaces 134, 136 are provided on each of the sharpening modules 104, 106. In this way, during a powered sharpening operation, a user can place opposing sides of a blade of a knife against the respective guide surfaces 134, 136 in succession to sharpen the cutting edge of the knife against the respective abrasive discs 118, 120. For this reason, the guide surfaces may also be referred to as powered stage guide surfaces or outer guide surfaces. It will be noted that in this configuration, the discs 118, 120 both rotate in the same direction with respect to the cutting tool in each of the sharpening stages (e.g., down and across, etc.).

Figure 3:
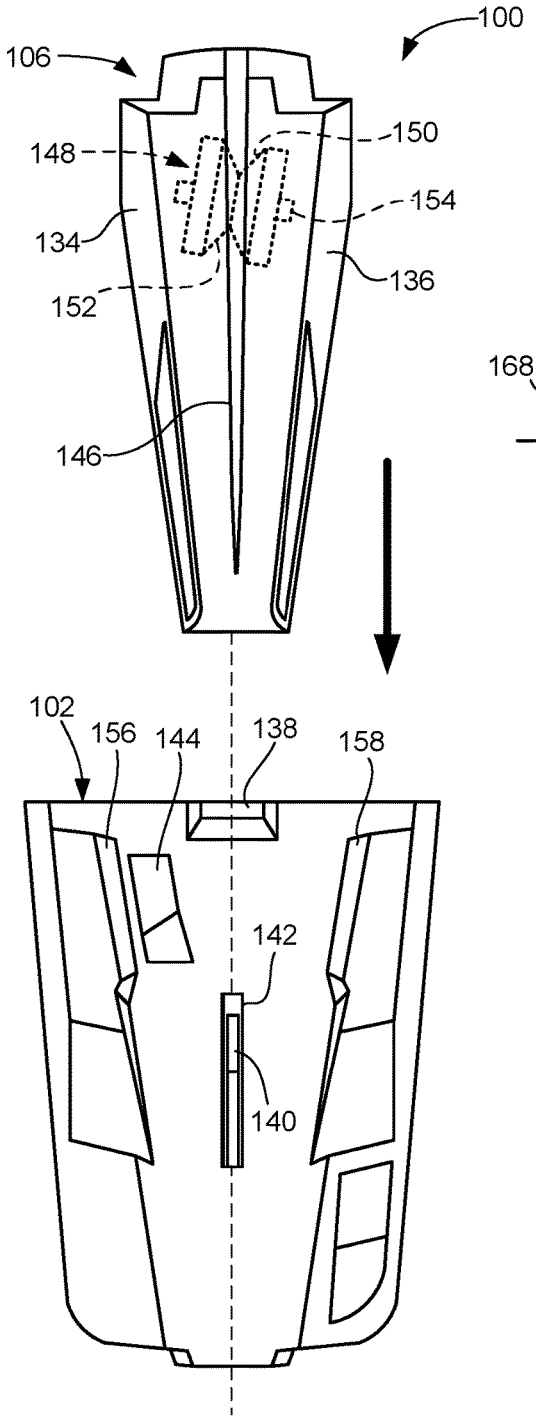
FIG. 3 shows a top plan view of the sharpener to illustrate engagement of a manual sharpening module of the sharpener with a base unit of the sharpener in some embodiments.

FIG. 3 provides a top plan representation of the sharpener 100 to illustrate installation of a selected manual sharpening module (in this case, the pocket knife module 106) onto the base unit 102. By sliding the module 106 forward, mechanical engagement is made with an alignment feature 138 of the top cover 112 and a rigid retention hook 140 that extends from the base member 110 through an opening 142. In this way, engagement of either module locks the top cover to the base unit (e.g., locks the housing closed). For reference, support 144 in FIG. 3 can be used to support a pair of scissors during a sharpening operation against the first disc 118.

Each of the modules 104, 106 includes a central aperture (slot) 146 that extends in a longitudinal direction along the overall length of the associated module. The slot 146, also sometimes referred to as a manual sharpening stage or a honing stage, provides non-contacting access to an interior manual sharpening member 148, which in FIG. 3 is depicted as a double canted sharpening wheel with two frusto-conical surfaces 150, 152 in facing relation to one another. The wheel 148 freely rotates about a sharpening wheel shaft 154 that is canted at an acute angle with respect to the slot 146, such as on the order of about 25 degrees.

While not limiting, it is contemplated that the sharpening wheel will be formed of ceramic, although other materials may be used. A double canted sharpening wheel such as 148 provides a honing action on opposing sides of the blade along the intersection of the respective axes of the frusto-conical surfaces 150, 152. The slot allows the blade of the knife to be advanced and retracted along the length of the cutting edge against the wheel.

Referring again to the base unit 102 in FIG. 3, clearance surfaces 156, 158 project in facing relation to the contacting guide surfaces 134, 136 of the associated sharpening module to allow access to the respective flexible discs. The clearance surfaces 156, 158 are best viewed in FIG. 2A (not shown in FIG. 3) and form outer portions of the sharpening ports 130, 132 during sharpening when the modules 104, 106 are respectively installed.

Figure 4A:
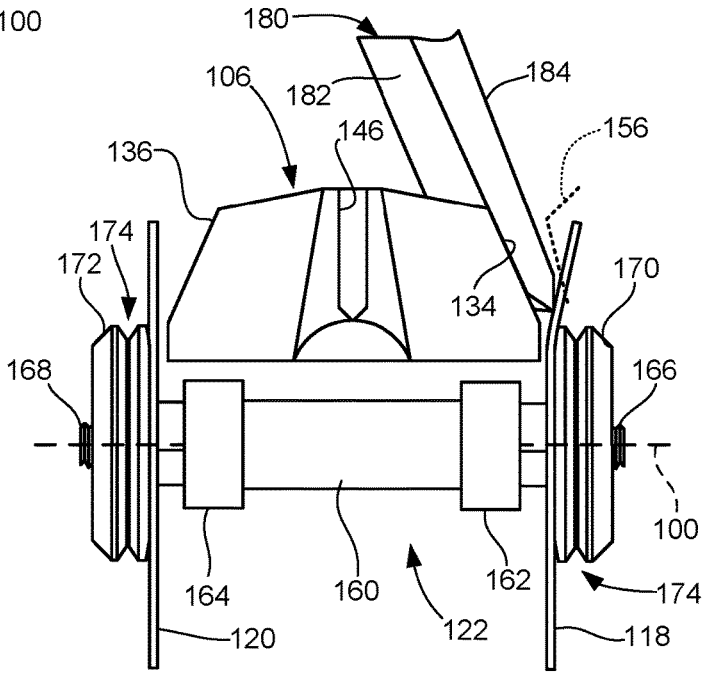
FIG. 4A depicts a primary sharpening operation using the rotatable flexible discs of the base unit.
Figure 4B:
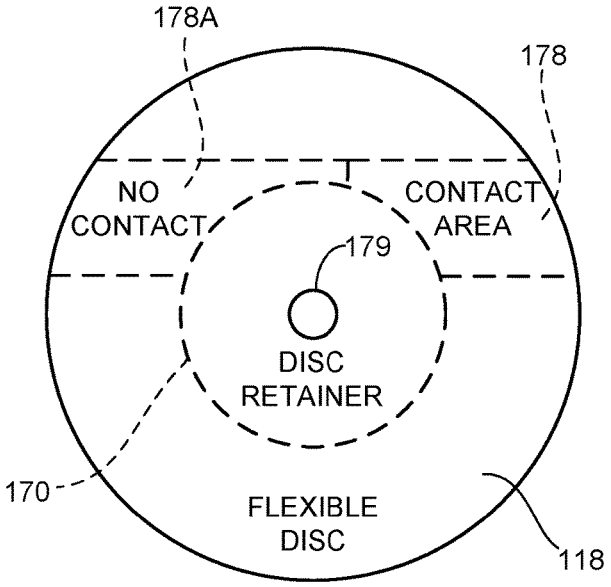
FIG. 4B shows a relationship between a disc retainer and a flexible disc during the primary sharpening operation of FIG. 4A.

FIGS. 4A and 4B show further aspects of the respective flexible abrasive discs 118, 120 in some embodiments. It will be appreciated that these drawings are schematic in nature and therefore serve to generally illustrate the sharpening operation carried out against the flexible discs 118, 120. The shaft assembly 122 from FIG. 2 is shown more fully to include a central shaft 160 supported by respective bearing assemblies 162, 164. The shaft 160 has threaded ends 166, 168, which are threadingly engaged by a pair of annular disc retainers 170, 172.

The disc retainers 170, 172 are nominally identical and each have a central annular groove 176. The groove 176 accommodates the belt 128 (see FIG. 2) on the side with the disc 118. The retainers are configured to be easily installed and removed by a user threadingly engaging the retainers with the threaded ends of the shaft. This allows the user to replace or rotate (flip) the rotatable discs 118, 120. The retainers can take any suitable construction including metal, plastic, etc.

As depicted in FIG. 4B, the retainers 170, 172 cover a substantial portion of the backside of each of the discs 118, 120, providing mechanical support for the inner radial extend of the associated discs. Adjacent the retainer is a contact area 178, as generally depicted in FIG. 4B, which is the region against which a cutting edge of a blade 180 (as shown in FIG. 4A) contacts the associated disc during disc rotation. The contact area 178 is located along the near side of the discs 118, 120 closest to the user so that the cutting edge is sharpened on a single side of the disc shaft 122; it will be noted from FIG. 3 that the inwardly directed guides 134, 136 cause the forward portion of the cutting edge to not contact the other side of the disc, as generally depicted by the so-called "non-contact" area 178A.

Because each retainer is offset from the contact area, the flexible disc can be deflected back and follow the contour of the blade. The edge of the retainer disc is recessed as shown so that, generally, higher surface pressure is applied for thicker blades and lower surface pressure is applied to thinner blades. A central aperture (hole) 179 in the disc allows the disc to slip over the associated threaded end 166, 168 of the central shaft 160 during disc installation.

Returning to FIG. 4A, the blade 180 has opposing sides 182, 184. The side 182 is contactingly supported against guide surface 134 of the manual sharpening module 106 to sharpen a first side of the blade against disc 118. The side 184 is similarly contactingly supported against guide surface 136 to sharpen the opposing second side of the blade against disc 120. Because the guide surfaces 134, 136 are angled inwardly (see top plan view of FIG. 3), the blade 180 in FIG. 4A follows this angle and thus is skewed with respect to the end-view vantage point of FIG. 4A.

A primary (or powered) sharpening operation can thus be carried out by presenting each side of the blade 180 in the respective sharpening slots 130, 132 in turn. In some cases, the motor 124 can be configured to rotate the respective discs 118, 120 at a fixed rotational rate suitable for a primary sharpening operation. In other cases, the motor 124 can be configured to operate at different speeds and/or over different time periods to accomplish different forms of sharpening.

In one non-limiting embodiment, a primary sharpening operation using the flexible discs 118, 120 can include a sharpening cycle which includes a first higher (sharpening) speed to quickly abrade the bevel and a second lower (refine) speed to reduce/remove any burr formed in the first higher speed. The times for each of the speeds is controlled by a motor control circuit (not shown) coupled to the motor. This sequence can be carried out by the user depressing a single button on the unit.

After the sharpening cycle, a second shaping cycle can be initiated by an alternate input from the user. The shaping cycle provides a third higher (shape) speed/time to re-shape/re-store excessively dull or damaged edges followed by a low (refine) speed to remove/reduce any burr formed in the previous high speed operation. This third higher shape speed increases a component of centrifugal force acting on the disc and subsequently further increases the material take off (MTO) of the shape step.

The reduction in speeds provided during the refine speed of sharpening and shape cycles reduces a component of centrifugal force acting on the disc and subsequently further reduces the MTO of the refine step.

Figure 5A:
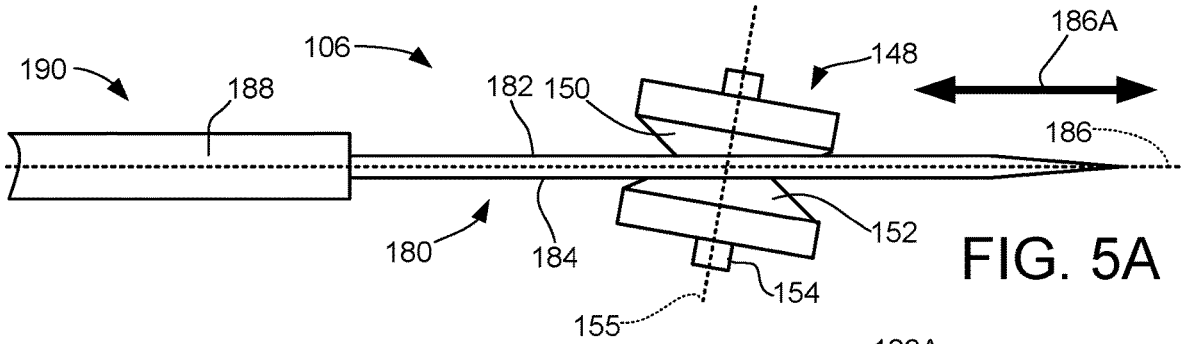
FIG. 5A is a top plan view of a secondary sharpening operation using the manual sharpening module.
Figure 5B:
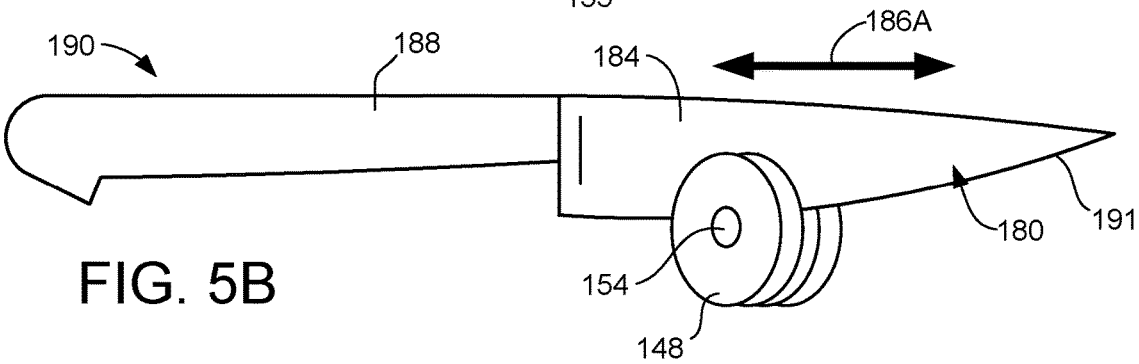
FIG. 5B represents a side view of the secondary sharpening operation.

FIGS. 5A and 5B show the sharpening wheel 148 within each of the modules 104, 106 in greater detail in conjunction with a cutting tool (knife) 190 of which the blade 180 forms a part. The sharpening wheel 148 can have a single piece or multi-piece construction, and can have any suitable outer surface configuration to provide honing and refining of the blade 180. As will be recognized, compressive forces are applied to opposing sides of the blade by the respective conical surfaces 150, 152 as the blade is advanced and the wheel rolls about shaft 154. The shaft 154 is angled at a desired skew angle to rotate about skew wheel axis 155.

During a manual (secondary) sharpening operation, including after the conclusion of a powered (primary) sharpening operation as described above against the discs 118, 120, the user can place the blade 180 into the slot 146 (honing stage) and advance/retract the blade against the wheel 148 a suitable number of times, such as ten times (10×), along a cutting tool drawing axis 186 as depicted by reciprocal arrow 186A. The user may grasp a handle 188 affixed to the blade 180 of the knife 190 to manipulate the blade during both primary and secondary sharpening operations in the respective powered and manual sharpening stages (e.g., 130, 132, 146). The honing operation refines a cutting edge 191 established at the intersection of the respective sides 182, 184 of the blade.

With reference again to FIG. 4A, it will be noted that the user directs the blade 180 in the same general direction (e.g., away from the user) during both the primary and secondary sharpening operations, but the blade is skewed inwardly by the tapered guide surfaces 134, 136 during the primary sharpening operations as compared to a forward front-to-back direction along drawing axis 186 during the secondary sharpening operations. This amount of skew can vary, but may be on the order of from about 10 degrees to about 30 degrees. Other ranges of skew angle can be used as desired.

Figure 6:
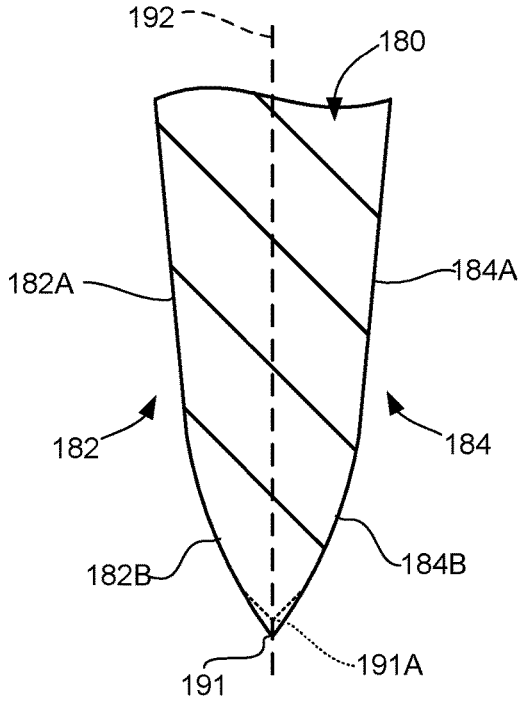
FIG. 6 shows a sharpening geometry achieved using the primary and sharpening operations of FIGS. 4-5 upon a blade in some embodiments.

FIG. 6 shows a cross-sectional, schematic depiction of the blade 180 processed by the sharpener 100 in some embodiments. Generally, the blade 180 is provided with a convex sharpening geometry so that side 182 has one or more linear extents 182A and one or more curvilinear extents 182B, and side 184 similarly has linear and curvilinear extents 184A and 184B. The different sharpening speeds and media can provide micro-bevels and other features to enhance sharpness and durability of the cutting edge 191. One such micro-bevel is represented at 191A. The micro-bevel 191A locally increases the angle of the blade in the proximity of the cutting edge to strengthen the blade and enhance the sharpness and durability of the cutting edge. The blade 180 is shown to be nominally symmetric about center line 192, but other blade geometries including asymmetric geometries can be sharpened in similar fashion. It will be noted that the center line 192 in FIG. 6 is nominally orthogonal to the drawing axis 186 in FIG. 5A.

Figure 7A:
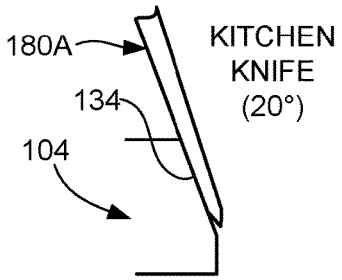
FIGS. 7A and 7B depict different presentation angles provided by the respective manual sharpening modules.
Figure 7B:
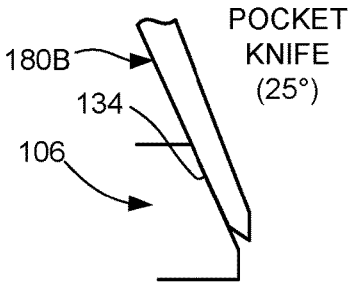

FIGS. 7A and 7B show differences between the respective manual sharpening modules 104, 106 in some embodiments. The kitchen knife module 104 in FIG. 7A accommodates thinner blades 180A and provides a first presentation angle such as on the order of nominally 20 degrees. The pocket knife module 106 in FIG. 7B accommodates thicker blades 180B and provides a different, second presentation angle such as on the order of nominally 25 degrees. Other angles can be used as desired.

In some cases, further micro-beveling can be provided by taking a given blade and first using the module 104 to support the blade at the first angle (e.g., 20 degrees) against the powered discs, followed by using the second module 106 to support the blade at the second angle (e.g., 25 degrees) against the powered discs. While not limiting, the respective slots 146 in the modules 104, 106 may have different respective widths to accommodate the associated blades, so that the slot in module 106 may be slightly wider than the slot in module 104. It will be noted that the slots 146 do not serve as guide surfaces during the secondary manual sharpening operation.

Figure 8A:
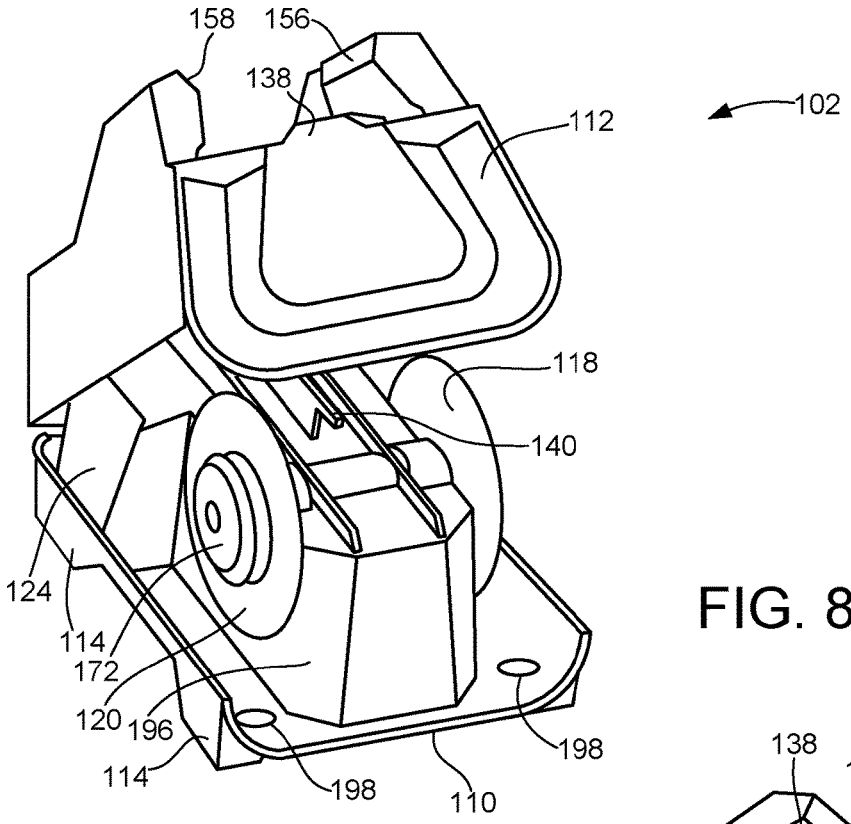
FIGS. 8A and 8B show interior views of the base unit.
Figure 8B:
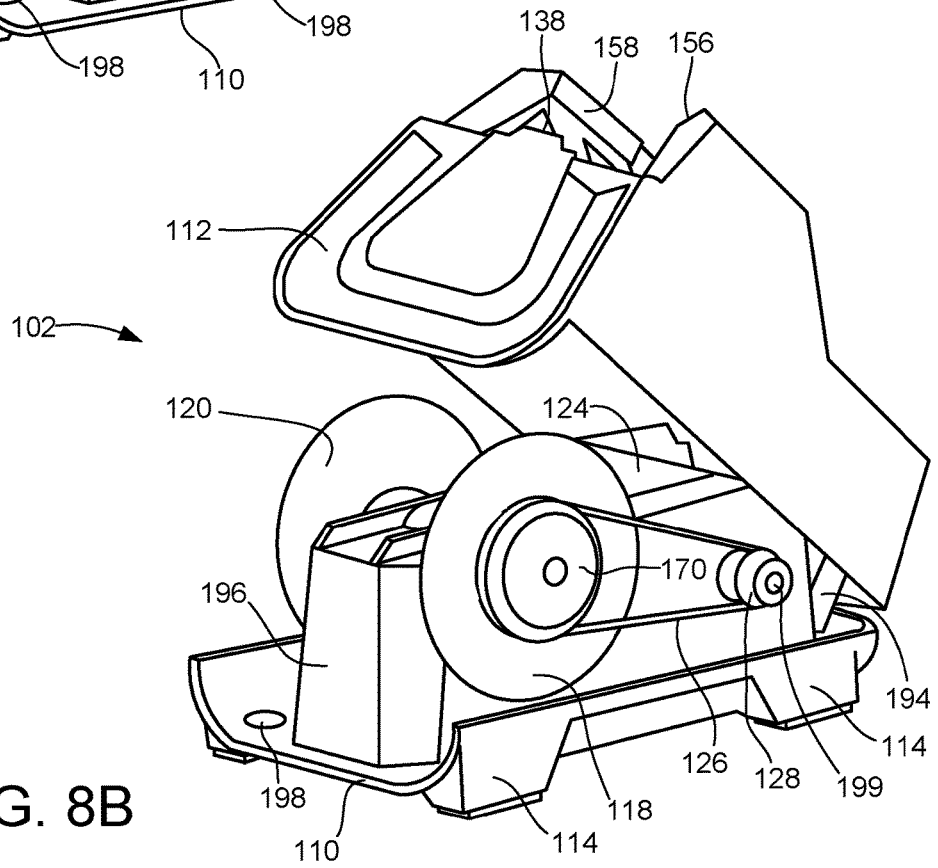

FIGS. 8A and 8B show respective isometric views of the base unit 102 of the sharpener 100 in some embodiments. In these figures, the modules 104, 106 have been disconnected from the base unit and the top cover 112 has been raised relative to the base member 110 using a pair of hinges located at the rear of the unit (one such hinge is denoted at 194).

Various internal elements described above are depicted in FIGS. 8A and 8B including the flexible abrasive discs 118, 120; the motor 124; the belt 126; the pulley 128; the retention hook 140; the disc retainers 170, 172; and the motor control board/circuit (not separately numerically designated). These elements are supported by a central boss 196 which extends upwardly from the base member 110 as shown.

A pair of disc-shaped magnets 198 are provided in the base member 110 below the respective flexible discs 118, 120. The magnets collect collect swarf (particles, etc.), via magnetic attraction, that have been removed from the blades during primary sharpening operations using the discs.

It is noted that the aforementioned pulley 128 is affixed to a motor shaft 199 driven by the electric motor 124. The motor shaft 199 is nominally parallel to the central shaft 160 supporting the discs 118, 120. The central shaft is housed within the central boss 196 but is depicted including in FIG. 4A. The belt 126 thus serves as a power transfer belt to to transfer power from the electric motor to the central shaft, and hence, the discs 118, 120 and disc retainers 170, 172.

Figure 9A:
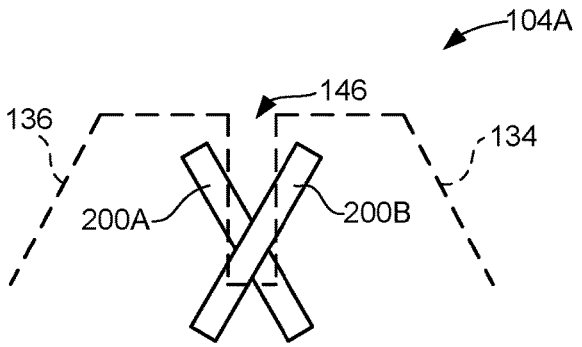
FIGS. 9A through 9D illustrate alternative constructions for the manual sharpening modules in further embodiments.

FIGS. 9A through 9D show alternative constructions for the respective manual sharpening modules 104, 106 discussed above. FIG. 9A shows an alternative manual sharpening module 104A in which a pair of intersecting elements 200A. 200B are provided. The elements 200A. 200B are characterized as intersecting, cylindrically shaped ceramic rods.

As described above, after sharpening the blade on a flexible abrasive disc the user may place the blade 180 (FIGS. 5A-5B) into the slot 146 at a position bisecting the honing elements 200A, 200B and draw the blade along its full length along the drawing axis 186 (FIG. 5A). This action serves to refine the cutting edge 191 by abrasive action or cold forming the fine striations present on the cutting edge after sharpening. It will be noted that the respective angles of the rods 200A, 200B may be selected in relation to the angles of the guide surfaces 134, 136 to effect a desired micro-beveling of the cutting edge of the tool.

Figure 9B:
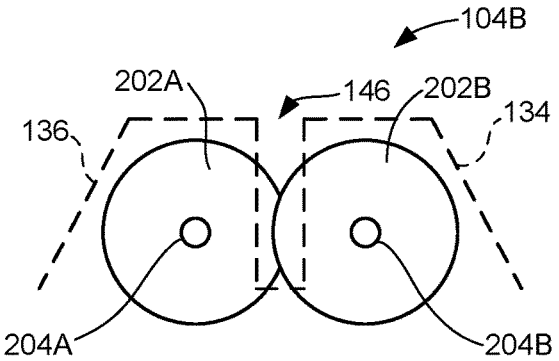

FIG. 9B shows an alternative manual sharpening module 104B in which a pair of intersecting discs 202A, 202B are arranged as shown. The discs 202A, 202B are hard metal discs rotatable about shaft members 204A, 204B, which extend along rotational axes that are nominally parallel to the drawing axis 186 along which the tool is withdrawn through the slot 146. In this way, the discs 202A, 202B provide a hollow ground (concave) sharpening geometry to the retracted cutting tool.

Figure 9C:
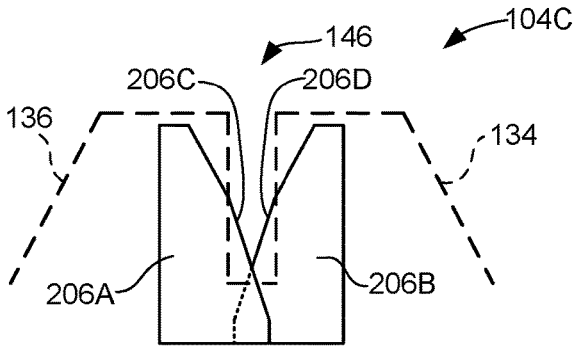

FIG. 9C shows yet another alternative manual sharpening module 104C in which sharpening elements 206A, 206B are provided. The elements 206A, 206B are each characterized as rigid metal plates that intersect as shown. The plates can be formed of any suitable rigid material such as carbide, etc. and form a v-shaped groove through which the tool can be drawn within the slot 146 along the drawing axis 186 to hone the cutting edge of the tool. As before, the angles of the inwardly facing cutting surfaces (denoted at 206C and 206D) can be different from and selected in relation to the angles of the support surfaces 134, 136.

Figure 9D:
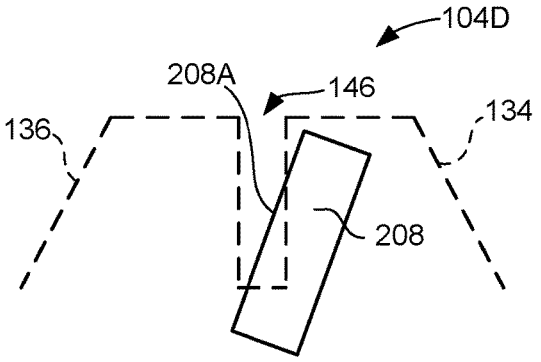

FIG. 9D provides another alternative manual sharpening module 104D in which only a single sharpening element 208 is provided. The sharpening element 208 has an abrasive surface 208A that is angled within the slot 146 to provide a secondary sharpening operation on a single side of the blade 180. The sharpening element 208 can take the form of an abrasive block or some other configuration. FIG. 9D illustrates that, while it is contemplated that the secondary sharpening operation may involve a pair of intersecting sharpening elements, such is not necessarily required since a single sharpening element, or more than two sharpening elements, can be used. Similarly, while the aforedescribed embodiments have illustrated the use of two powered sharpening elements (e.g., flexible discs 118, 120), other forms and numbers of powered sharpening elements, including just a single powered sharpening element, or more than two powered sharpening elements, can be used.

Figure 10A:
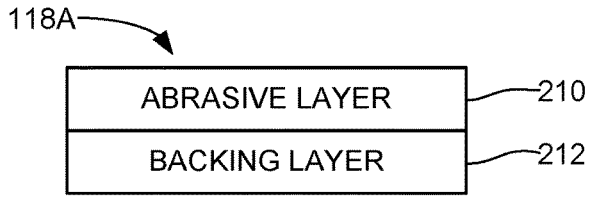
FIGS. 10A and 10B show different alternative configurations for the flexible abrasive discs in some embodiments.
Figure 10B:
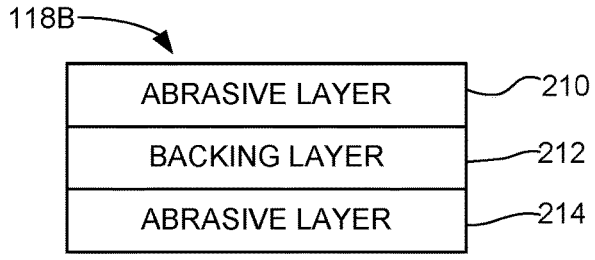

FIGS. 10A and 10B show further constructions that can be used for the powered abrasive discs 118, 120 in some embodiments. FIG. 10A shows a single-sided flexible abrasive disc 118A having a single abrasive layer 210 affixed to a backing layer 212. In this case, the abrasive layer is arranged to be facing inwardly and the associated disc retainer 170, 172 is clamped onto the backing layer 212.

FIG. 10B shows a double-sided flexible abrasive disc 118B, with the aforementioned layers 210, 212 along with a second abrasive layer 214 on the opposing side of the backing (medial) layer. An advantage of the construction in FIG. 10B is that, once a selected one of the abrasive layers 210, 214 has become sufficiently worn, the user can easily raise the cover 112 as in FIGS. 8A-8B, remove the associated disc retainer, reverse the orientation of the disc 118B and reinstall the disc retainer.

Another configuration can provide powered sharpening ports to enable the cutting tool to be alternately presented against each side of the double sided abrasive disc to respectively sharpen each side of the tool in turn. In this latter case, multiple powered sharpening guide surfaces can be incorporated into the manual sharpening module and the manual sharpening element(s) within the manual sharpening module may be offset from the powered sharpening stages rather than necessarily located therebetween.

The abrasive layer(s) can take any number of suitable forms and abrasiveness (grit) levels. In some cases, the layers are formed of sandpaper media with a grit in the range of from about 120-240. Other ranges and forms of abrasive particles can be used as desired. The backing layer is any suitable flexible material such as cloth or paper. It is contemplated that the abrasive layers on the respective discs will have a common abrasiveness level, but this is not necessarily required in that one surface could have a more coarse grit and the other surface could have a more refined grit.

Figure 11:
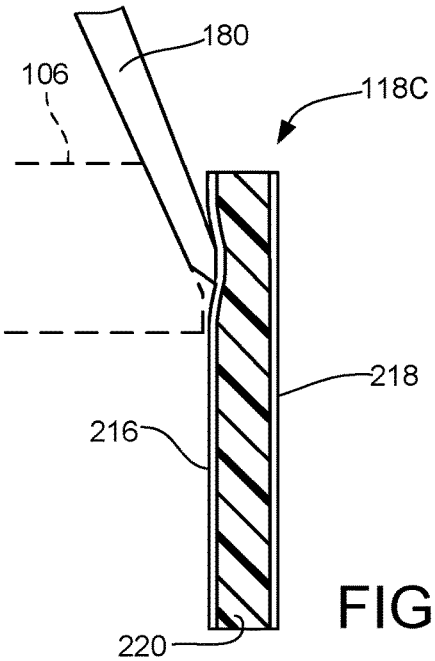
FIG. 11 illustrates an alternative construction for the rotatable flexible abrasive disc in further embodiments.

FIG. 11 illustrates yet another alternative configuration for a flexible disc 118C that can be used in some embodiments for the respective discs 118, 120. The disc 118C includes opposing abrasive layers 216, 218 bonded to opposing sides of an intermediary compressive resilient substrate 220. The substrate 220 can take a variety of forms such as foam rubber. This allows the abrasive layers 216, 218 to deform as described above, with the substrate 220 providing backing force to oppose the surface pressure supplied by the presentation of the blade 180.

While it is contemplated that the various embodiments discussed herein have used powered abrasive media in the form of flexible abrasive discs, aspects of the various embodiments can be utilized with other forms of moveable media, such as but not limited to endless abrasive belts, rigid grinding wheels, etc.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A sharpener for sharpening a cutting tool having a cutting edge, the sharpener comprising:

a housing;

a flexible abrasive disc mounted to a central shaft within the housing to provide a powered sharpening stage;

an electric motor disposed within the housing and configured to rotate the flexible abrasive disc in a selected rotational direction; and a manual sharpening module removably attachable to the housing at a location adjacent the powered sharpening stage, the manual sharpening module having a powered stage guide surface configured to support a first side of the cutting tool during presentation of an opposing second side of the cutting tool against the flexible abrasive disc to effect a primary sharpening operation upon the cutting edge, the manual sharpening module further having an elongated access slot to facilitate movement of the cutting tool against a manual sharpening element along a cutting tool drawing axis to effect a secondary sharpening operation upon the cutting edge.

2. The sharpener of claim 1, wherein the flexible abrasive disc is a first flexible abrasive disc, the powered sharpening stage is a first powered sharpening stage and the powered stage guide surface is a first powered stage guide surface, wherein the sharpener further comprises a second flexible abrasive disc mounted to the central shaft within the housing to provide a second powered sharpening stage, wherein the manual sharpening module further has a second powered stage guide surface configured to support the second side of the cutting tool during presentation of the first side of the cutting tool against the second flexible abrasive disc, and wherein the manual sharpening module is disposed between the first and second powered sharpening stages.

3. The sharpener of claim 1, wherein the powered stage guide surface is skewed with respect to the cutting tool drawing axis by an intervening angle of from about 10 degrees to about 30 degrees.

4. The sharpener of claim 1, wherein the electric motor has a motor shaft to which a pulley is affixed, a power transfer belt extends from the pulley to the central shaft to transfer power from the electric motor to the central shaft, and the central shaft and the motor shaft are nominally parallel.

5. The sharpener of claim 1, wherein the powered sharpening stage is formed by attachment of the manual sharpening module to a top surface of the housing so that the powered stage guide surface forms one side of the powered sharpening stage and a portion of the housing forms an opposing second side of the powered sharpening stage.

6. The sharpener of claim 1, wherein the housing comprises a base member and a top cover connected to the base member using a hinge assembly, wherein a rigid hook extends from the base member through an opening in the top cover to engage the manual sharpening module and lock the top cover to the base member, and wherein removal of the manual sharpening module from the hook enables the top cover to be pivoted with respect to the base member via the hinge assembly to provide user access to the first and second flexible abrasive discs.

7. The sharpener of claim 1, wherein the manual sharpening element of the manual sharpening module comprises a sharpening wheel.

8. The sharpener of claim 7, the sharpening wheel comprising a pair of facing frusto-conical surfaces and mounted at a selected acute angle with respect to the slot such that presentation and rolling of the cutting edge along the wheel provides compressive forces on opposing sides of the cutting tool as the cutting tool is retracted along the cutting tool drawing axis.

9. The sharpener of claim 1, wherein the manual sharpening element of the manual sharpening module comprises at least a selected one of an abrasive block, an abrasive rod, an abrasive disc or a metal plate.

10. A sharpener for sharpening a cutting tool having a blade with opposing first and second sides that converge to an intervening cutting edge, the sharpener comprising:

a housing;

first and second flexible abrasive discs mounted to a central shaft in a spaced apart relation within the housing to provide opposing first and second powered sharpening stages in which abrasive surfaces of the respective first and second flexible abrasive discs move in a common direction with respect to the cutting tool;

an electric motor disposed within the housing and configured to rotate the first and second flexible abrasive discs in a selected rotational direction; and a manual sharpening module affixed to the housing between the first and second powered sharpening stages, the manual sharpening module having opposing first and second guide surfaces configured to respectively support the opposing first and second sides of the blade during presentation of the corresponding second and first sides of the blade against the respective first and second flexible abrasive discs, the manual sharpening module comprising a honing stage having an elongated access slot to facilitate presentation of the cutting edge against a manual honing element disposed within the access slot.

11. The sharpener of claim 10, wherein the manual honing element of the manual sharpening module comprises a pair of intersecting elements that form a v-shaped channel through which the cutting tool is configured to be drawn during a honing operation.

12. The sharpener of claim 10, wherein the manual honing element of the manual sharpening module comprises at least a selected one of a frusto-conically shaped skew wheel, a pair of steel plates, a pair of abrasive rods, a pair of rotatable discs, or a single abrasive block.

13. The sharpener of claim 10, further comprising first and second annular disc retainers configured to threadingly engage opposing first and second ends of the central shaft to secure the first and second rotatable flexible abrasive discs thereto, each of the first and second annular disc retainers extending a portion of an overall radius of the associated first or second rotatable flexible abrasive disc to provide a bias force to an opposing second side of the associated first or second rotatable flexible abrasive disc during presentation of the cutting edge of the cutting tool against a contact area on a first side of the associated first or second rotatable flexible abrasive disc.

14. The sharpener of claim 10, wherein each of the first and second flexible abrasive discs is characterized as a single-sided abrasive disc having an abrasive layer on a first side and a non-abrasive backing layer on an opposing second side.

15. The sharpener of claim 10, wherein each of the first and second flexible abrasive discs is characterized as a double-sided abrasive disc having first and second abrasive layers on opposing sides of an intermediary backing layer.

16. The sharpener of claim 15, wherein the intermediary backing layer is formed of a selected one of cloth, paper or foam rubber.

17. The sharpener of claim 10, further comprising a magnet disposed within the housing adjacent a selected one of the first or second rotatable flexible abrasive discs to magnetically retain swarf responsive to a primary sharpening operation.

18. The sharpener of claim 10, wherein the manual sharpening module is configured to be removably attachable to the housing via sliding engagement of a first retention member on a main body portion of the manual sharpening module with a second retention member of the housing.

19. The sharpener of claim 10, wherein the manual sharpening module is characterized as a first manual sharpening module and the opposing first and second guide surfaces of the first manual sharpening module extend at a first selected guide angle, wherein the sharpener further comprises a second manual sharpening module having a second manual honing element in a second honing stage and opposing third and fourth guide surfaces which extend at a different, second selected guide angle, wherein each of the first and second manual sharpening modules can be separately installed between the first and second powered sharpening stages to provide different sharpening angles to the cutting tool against the respective first and second flexible abrasive discs.

20. A method for sharpening a cutting tool having opposing first and second sides that converge to an intervening cutting edge, the method comprising:

inserting the cutting tool into a first powered sharpening stage of a powered sharpener to perform a primary sharpening operation upon the cutting edge, the powered sharpener having a housing which encloses an electric motor configured to rotate a first flexible abrasive disc in a selected rotational direction, and a removably attachable manual sharpening module having a main body with a powered stage guide surface and an interior manual sharpening element, the powered stage guide surface supporting the second side of the cutting tool during contacting engagement of the first side of the cutting tool against the first flexible abrasive disc; and drawing the cutting tool through an elongated slot of the manual sharpening module to draw the cutting tool against the manual sharpening element to perform a secondary sharpening operation upon the cutting edge.

21. The method of claim 20, further comprising removing the manual sharpening module from the housing of the powered sharpener after the inserting step and prior to the drawing step.

22. The method of claim 20, wherein the sharpener further comprises a second flexible abrasive disc mounted to the central shaft within the housing to provide a second powered sharpening stage, and wherein the method further comprises subsequently inserting the cutting tool into the second powered sharpening stage to perform a second primary sharpening operation upon the cutting edge, the manual sharpening module having a second powered stage guide surface which supports the first side of the cutting tool during contacting engagement of the second side of the cutting tool against the second flexible abrasive disc.

23. The method of claim 22, wherein the manual sharpening module is characterized as a first removable manual sharpening module that can be removably affixed to the housing, wherein the first and second powered stage guide surfaces of the first removable manual sharpening module extend at a first selected angle, and wherein the method further comprises removing the first removable manual sharpening module from the housing and installing a second removable manual sharpening module to the housing between the first and second powered sharpening stages, the second removable manual sharpening module having a second manual sharpening element in a second elongated slot and opposing third and fourth powered stage guide surfaces that extend at a different, second selected angle to form respective portions of the first and second powered sharpening stages.

24. The method of claim 20, further comprising using a magnet disposed within the housing adjacent the first flexible abrasive disc to magnetically retain swarf generated during the primary sharpening operation.

* * * * *